US008001917B2

(12) United States Patent
Åstrand

(10) Patent No.: US 8,001,917 B2
(45) Date of Patent: Aug. 23, 2011

(54) WEB FRAME

(75) Inventor: Daniel Åstrand, Götenborg (SE)

(73) Assignee: Kellogg Brown & Root LLC, Houston, TX (US)

( * ) Notice: Subject to any disclaimer, the term of this patent is extended or adjusted under 35 U.S.C. 154(b) by 137 days.

(21) Appl. No.: 12/347,205

(22) Filed: Dec. 31, 2008

(65) Prior Publication Data

US 2010/0000460 A1 Jan. 7, 2010

(30) Foreign Application Priority Data

Jul. 7, 2008 (SE) ..... 0801622

(51) Int. Cl.
*B63B 35/44* (2006.01)

(52) U.S. Cl. ..... 114/264

(58) Field of Classification Search ..... 114/243, 114/264

See application file for complete search history.

(56) References Cited

U.S. PATENT DOCUMENTS 1,808,599 A 6/1931 Galeazzi
3,717,113 A * 2/1973 Wilde ..... 114/264
3,842,772 A 10/1974 Lang
4,479,742 A * 10/1984 Bruce ..... 405/217
4,633,970 A * 1/1987 Mifsud ..... 181/120
4,928,614 A 5/1990 Forman
5,477,798 A 12/1995 Ness
5,722,797 A * 3/1998 Horton, III ..... 405/224
6,102,625 A * 8/2000 Olsen et al. ..... 405/195.1
6,457,527 B2 * 10/2002 Wells ..... 166/350

FOREIGN PATENT DOCUMENTS

GB 1306885 2/1973
WO WO2005043030 5/2005

* cited by examiner

*Primary Examiner* — Stephen Avila
(74) *Attorney, Agent, or Firm* — KBR IP Legal Dept.

(57) ABSTRACT

A marine structure comprises a supporting member adapted to be located at least partially immersed in water. The supporting member comprises a wall at least partially delimiting the supporting member such that an inner side of the wall at least partially delimits an inner hollow volume of the supporting member and an outer side of the wall is adapted to be in contact with the ambient environment of the supporting member. The supporting member further comprises a stiffening web frame attached to the wall in order to modify the structural capacity of the supporting member, which stiffening web frame comprises a rib and a flang.

9 Claims, 5 Drawing Sheets

WEB FRAME

CROSS-REFERENCE TO RELATED APPLICATIONS

This application claims priority to Swedish Patent Application 0801622-2, filed with the Swedish Patent Office on Jul. 7, 2008, the entirety of which is incorporated by reference herein.

BACKGROUND

1. Field

The present embodiments relate to marine structures comprising a supporting member adapted to be located at least partially immersed in water. The supporting member comprises a wall at least partially delimiting the supporting member such that an inner side of the wall at least partially delimits an inner hollow volume of the supporting member and an outer side of the wall is adapted to be in contact with the ambient environment of the supporting member. The supporting member further comprises a stiffening web frame attached to the wall in order to modify the structural capacity of the supporting member, which stiffening web frame comprises a rib and a flange.

2. Description of the Related Art

Marine structures, such as for instance semi-submersibles and ships, are often constituted by a plurality of shells, or panels, at least partially enclosing a load carrying frame arrangement. An example of a ship constructed according to this principle is disclosed in U.S. Pat. No. 6,073,420 ('420) wherein a partial cross section of a tanker ship is illustrated, the hull of which is inwardly provided with a plurality of longitudinally extending web frames in order to increase the stiffness of the ship. Traditionally, the web frames extend inwardly from the shell or shells forming the outer surface of the ship in order to not impair the hydrodynamic characteristics, such as the drag, of the ship.

However, a general concern when designing marine structures is to obtain a low dead weight of the structure and the provision of a plurality of web frames will actually increase the weight of the ship. To this end, it should be noted that the sole purpose of the web frames according to '420 is to provide additional structural capacity to the ship.

Moreover, it should be noted that it may be difficult to use the inward volume of the marine structure being located closest to the shell or shells of the structure since this volume generally is encumbered with web frames.

As may be realized from the above, a need exists for improvements of marine structures comprising web frames.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
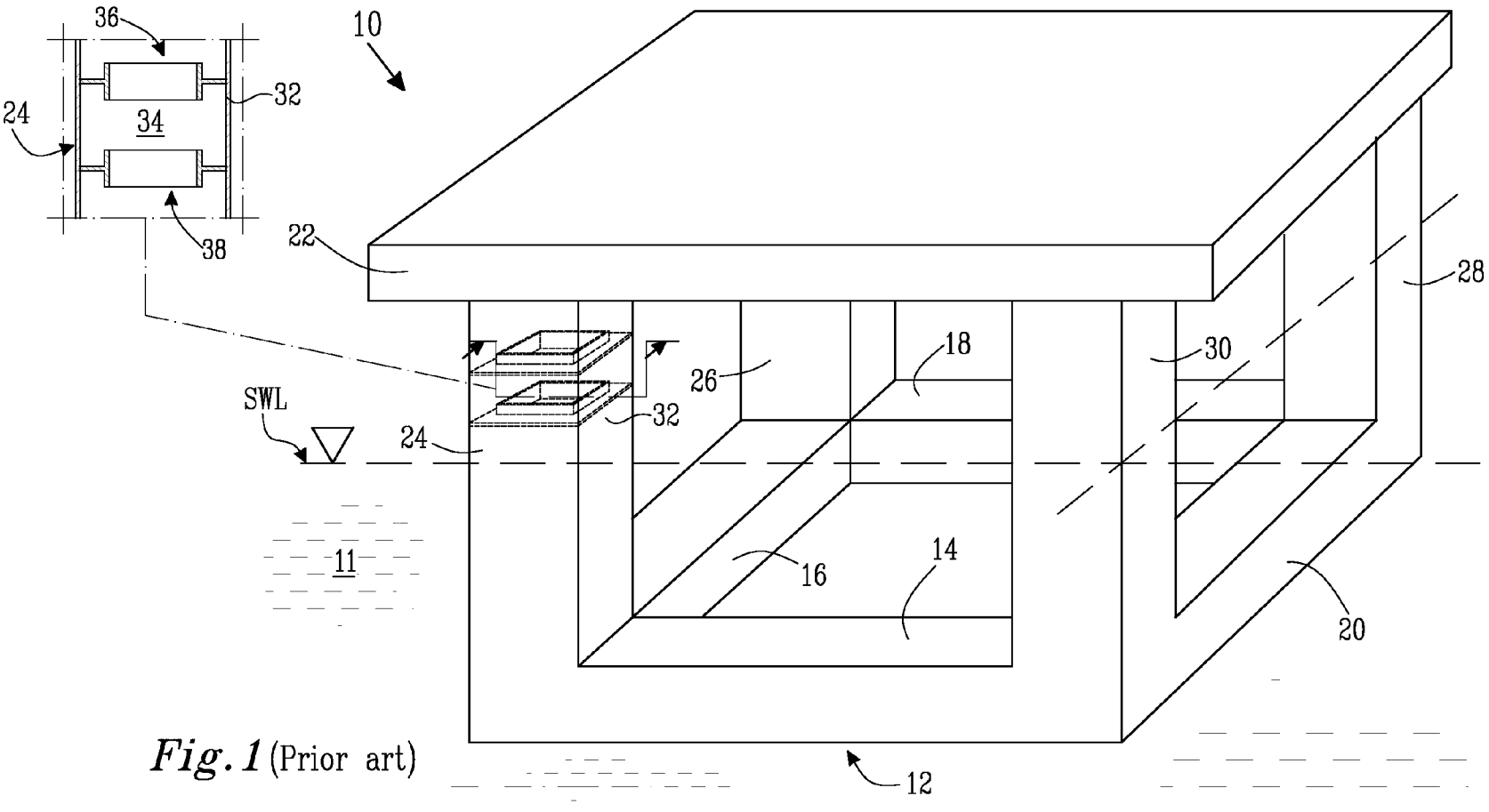
Fig. 1 (Prior art)
FIG. 1 illustrates a semi-submersible structure according to the prior art.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

A first object of the present invention is to provide a marine structure comprising a stiffening web frame, wherein the stiffening web frame is used for an additional purpose other than providing structural capacity to the marine structure.

A second object of the present invention is to provide a marine structure having a stiffening web frame, which structure provides an appropriately large hollow volume within the structure but which nevertheless provides appropriate structural capacity.

At least one of the aforementioned objectives is achieved by a marine structure according to claimed subject matter.

As such, the invention relates to a marine structure comprising a supporting member adapted to be located at least partially immersed in water, the supporting member comprising a wall at least partially delimiting the supporting member such that an inner side of the wall at least partially delimiting an inner hollow volume of the supporting member and an outer side of the wall is adapted to be in contact with the ambient environment of the supporting member, the supporting member further comprising a stiffening web frame attached to the wall in order to modify the structural capacity of the supporting member, the stiffening web frame comprising a rib and a flange, characterized in that the stiffening web frame is arranged such that the flange is located outside of the outer side of the wall in the ambient environment.

By using a marine structure according to the present invention, the available volume within the supporting member may be increased. Moreover, as will be apparent from the preferred embodiments hereinbelow, arranging the stiffening web frame such that its web is located outside of the wall provides for that the stiffening web frame may be used for an additional purpose apart from providing structural capacity.

Additionally, arranging the stiffening web frame outside the wall facilitates the manufacturing of the supporting member since there is generally more space available outside than inside the supporting member during a construction phase.

According to a preferred embodiment of the present invention, the wall extends along a longitudinal axis and the wall further forms a closed path in a circumferential direction about the longitudinal axis, wherein the stiffening web frame circumscribes the wall in a direction parallel to the circumferential direction.

According to another embodiment of the present invention, the marine structure comprises a deck structure, wherein the supporting member extends from the deck structure.

According to a further embodiment of the present invention, the supporting member is attached to the deck structure by means of a deck fastening arrangement and the stiffening web frame constitutes at least a portion of a deck enclosing member enclosing at least a portion of the deck fastening arrangement.

Arranging the stiffening web frame according to the above provides for that possible wave slamming load impacting an area of the deck fastening arrangement may be dealt with in an appropriate manner.

According to another embodiment of the present invention, the supporting member comprises an upper portion which is adapted to be located above a still water level when the marine structure is at least partially immersed in water, the stiffening web frame being located in the upper portion of the supporting member in order to impair wave run-up on the supporting member.

According to a further embodiment of the present invention, the marine structure further comprises a float, wherein the supporting member is attached to the float by means of a float fastening arrangement comprising at least one joint and the stiffening web frame constitutes at least a portion of a float enclosing member enclosing at least a portion of the joint.

The joint of the float fastening arrangement is generally heavily loaded when the marine structure is operating and the joint is at the same time located in a harsh environment, often salt water. As such, when enclosing the joint according to the above embodiment of the present invention, the joint will be located in a milder environment which may improve the strength—in particular the fatigue strength—of the joint.

According to a further embodiment of the present invention, the supporting member comprises two stiffening web frames: a first stiffening web frame adapted to be located above a still water level and a second stiffening web frame adapted to be located below the still water level, the first and second stiffening web frames being connected to one another, preferably by means of a panel, such that the supporting member comprises an enclosed volume being at least partially defined by the outer side of the wall, the first stiffening web frame and the second stiffening web frame.

Thus, by an arrangement according to the above, a fender may be obtained on the supporting member for providing additional buoyancy and water plane area to the marine structure at the same time as the stiffening web frames provide sufficient structural capacity, such as stiffness, to the supporting member.

According to a further embodiment of the present invention, the marine structure is a semi-submersible unit comprising a float, wherein the supporting member is a support column extending between the deck structure and the float.

A second aspect of the present invention relates to a marine structure adapted to be located at least partially immersed in water, the marine structure comprising an upper portion adapted to be located above a still water level when the marine structure is located in a body of water. According to the second aspect of the present invention, the upper portion comprises a wave deflecting member extending out from the marine structure in order to impair wave run-up on the marine structure.

According to a preferred embodiment of the second aspect of the present invention, the marine structure is a semi-submersible unit comprising a deck structure and a supporting member, wherein the supporting member extends from the deck structure and is adapted to be at least partially immersed in water.

According to another embodiment of the second aspect of the present invention, the wave deflecting member is located on the deck structure.

According to another embodiment of the second aspect of the present invention, the wave deflecting member is located on the supporting member.

According to another embodiment of the second aspect of the present invention, the wave deflecting member comprises a plurality of openings, preferably the wave deflecting member comprises a grating, in order to increase the amount of air in the water passing the wave deflecting member.

As may be realized by a person skilled in the art, the magnitude of a slamming pressure emanating from run-up waves is dependent on the amount of air introduced in the waves. By the provision of the openings in the wave deflecting member, the amount of air in the run-up wave is increased which thus reduces the resulting slamming force.

According to a further embodiment of the second aspect of the present invention, the wave deflecting member has a tapering extension such that a smallest distance from the upper portion to a portion of the wave deflecting member being located closest to the still water surface is less than a smallest distance from the upper portion to a portion of the wave deflecting member being located farthest away from the still water surface.

By an implementation of the wave deflecting member as presented hereinabove, the run-up waves will be deflected outwards from the marine structure, which further reduces the risk of slamming loads due to wave run-up.

According to another embodiment of the second aspect of the present invention, the structure comprises a plurality of wave deflecting members.

According to a further embodiment of the second aspect of the present invention, the marine structure is a semi-submersible unit comprising a deck structure and a float, wherein the marine structure further comprises a support column extending between the deck structure and the float.

According to a further embodiment of the second aspect of the present invention, the wave deflecting member is located on the support column.

A third aspect of the present invention relates to a use of a wave deflecting member on a marine structure according to the second aspect of the present invention in order to impair wave run-up on said marine structure.

With reference to the figures, FIG. 1 illustrates a marine structure 10 of the prior art, which marine structure in FIG. 1 is a semi-submersible ship, adapted to float in a body of water 11 with a still water level SWL. The marine structure comprises a float 12 which is adapted to be located at least partially in the body of water and in the implementation of the marine structure illustrated in FIG. 1, the float 12 is adapted to be located below the aforesaid still water level SWL. In the implementation of the marine structure 10 illustrated in FIG. 1, the float 12 is of a so called ring pontoon type and is thus constituted by four pontoons 14, 16, 18, 20 connected to one another so as to form the float 12. However, in other implementations of the marine structure 10, the float 12 may have a design which differs from the one illustrated in FIG. 1. As may be gleaned from FIG. 1, the marine structure 10 also comprises a deck structure 22, which deck structure 22 generally is adapted to be located above the still water level SWL.

Moreover, the marine structure 10 in FIG. 1 is provided with four supporting members, or columns, 24, 26, 28, 30 extending between the float 12 and the deck structure 22. Further, FIG. 1 illustrates a cross section of a portion of one of the supporting members 24 of the marine structure 10. As may be gleaned from the aforementioned cross section, the supporting member 24 comprises a wall 32 delimiting an inner hollow volume 34 in the supporting member and the supporting member is further provided with a plurality of stiffening web frames 36, 38 which are connected to the wall and are located within the hollow volume 34. Although it is not visible from FIG. 1, it should be noted each one of the pontoons, as well as the deck structure 22, preferably is provided with stiffening web frames in a similar manner as described with reference to the supporting member 24 hereinabove.

As may be realized from FIG. 1, although the provision of the stiffening web frames 36, 38 enhances the structural capacity, such as the stiffness, of the supporting members 24, the stiffening web frames 36, 38 at the same time take up space inside the supporting members 24. As such, the space available for elevators, storage compartments etcetera is reduced. Moreover, the weight and the position of the stiffening web frames 36, 38 will contribute to an increase of the vertical centre of gravity of the marine structure 10, which increase generally is undesired from e.g. a stability point of view. However, since the provision of the stiffening web frames 36, 38 nevertheless is required from a structural capacity point of view, it would be desirable to find an additional use of the stiffening web frames 36, 38.

Figure 2:
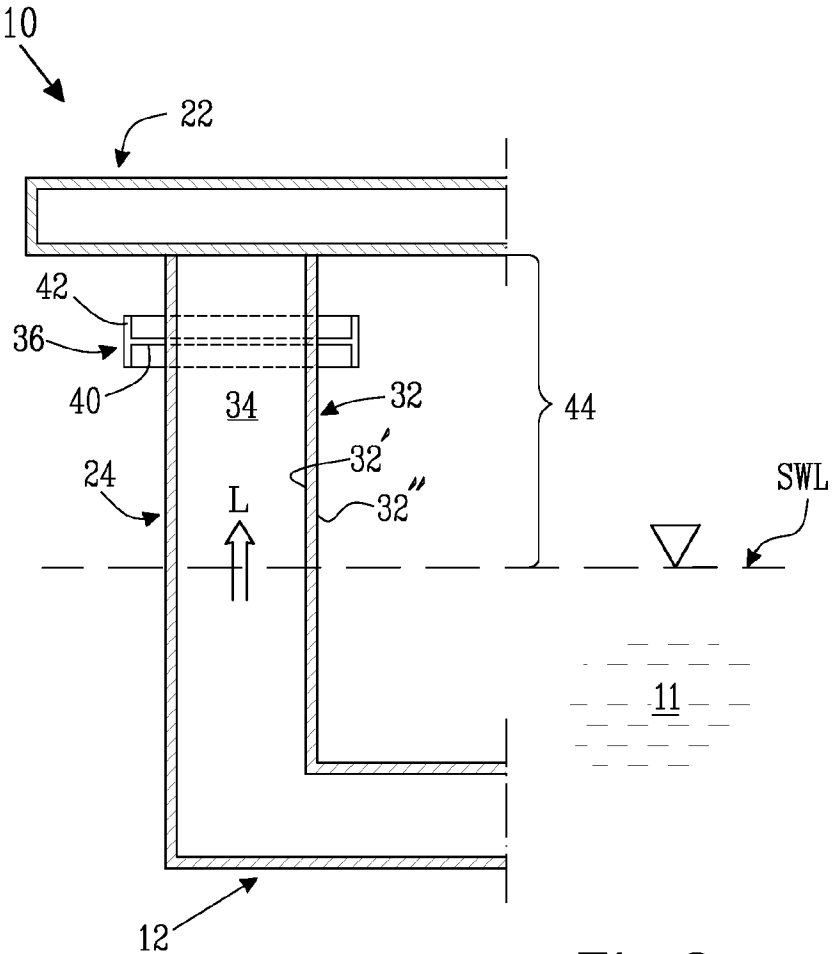
FIG. 2 illustrates a cross section of a portion of a semi-submersible structure according to the present invention.

FIG. 2 illustrates a side view of a cross section of a portion of a marine structure 10 according to an embodiment the present invention. The marine structure 10 comprises a float 14 and a deck structure 22 as well as a supporting member 24, which supporting member 24 in the embodiment illustrated in FIG. 2 is constituted by a column. The supporting member 24 generally has a substantially circular or rectangular cross section. The marine structure is adapted to float in a body of water 11 and the supporting member 24 is at least partially located in the body of water 11 such that the still water level SWL of the water intersects the supporting member 24.

The supporting member 24 comprises a wall 32 at least partially delimiting the supporting member 24 such that an inner side 32' of the wall 32 at least partially delimits an inner hollow volume 34 of the supporting member 24. Moreover, an outer side 32" of the wall 32 is adapted to be in contact with the ambient environment, which ambient environment generally is constituted by the body of water 11 or the air surrounding the upper portion of the supporting member 24.

The supporting member 24 further comprises a stiffening web frame 36 attached to the wall 32 in order to modify the structural capacity of the supporting member 24 and the stiffening web frame 36 comprises a rib 40 and a flange 42. Moreover, as may be gleaned from FIG. 2, the stiffening web frame 36 is arranged such that its flange 42 is located outside of the outer side 32" of the wall 32 in the ambient environment.

As such, as compared to the prior art location of the stiffening web frame 36 as indicated in FIG. 1, the location of the stiffening web frame 36 according to the present invention provides for an increase in the space available in the inner hollow volume 34.

The wall 32, as well as the stiffening web frame 36, are preferably made of steel and the flange 42 of the stiffening web frame 36 is generally oriented perpendicularly to the rib 40. In a cross section of the example of the stiffening web frame 36 illustrated in FIG. 2, the flange 42 and the rib 40 form a T-shaped structure although other implementations of the stiffening web frame 36 of course are possible, such as a web frame having an L-shaped cross section (not shown). The stiffening web frame 36 is attached to said wall 32 by a joint, such as a weld joint, preferably such that a portion of the rib 40 is fixedly attached to the outer side 32" of the wall 32.

In FIG. 2, the wall 32 extends in along a vertical axis, indicated by arrow L, from the float 12 to the deck structure 22. Moreover, the wall 32 further forms a closed path in a circumferential direction about the longitudinal axis L and the stiffening web frame 36 in the embodiment of the present invention as illustrated in FIG. 2 circumscribes the wall 32 in a direction parallel to the circumferential direction. Purely by way of example, the thickness of the rib 40 may be within the range of 10-40 mm and the length, which length in FIG. 2 is the extension of the rib 40 perpendicular to the longitudinal axis L, may be within the range of 0.5 to 3 meters. Moreover, again purely by way of example, the thickness of the flange 42 may be within the range of 10-40 mm and the height of the flange, which height in FIG. 2 is the extension of the flange 42 parallel to the longitudinal axis L, may be within the range of 0.1 to 0.5 meters.

It should be noted that the implementation of the stiffening web frame 36 illustrated in FIG. 2 has a constant cross section. However, in some embodiments of the present invention, the cross section of the stiffening web frame 36 may vary in the circumferential direction. Moreover, in some embodiments of the present invention, the stiffening web frame 36 may extend around only a part of the wall 32. Additionally, in some implementations of the stiffening web frame 36, at least a portion of the rib 40 and/or the flange 42 may be provided with openings (not shown).

As may be gleaned from FIG. 2, the stiffening web frame 36 is located in an upper portion 44 of the supporting member 24 which upper portion 44 is adapted to be located above the still water level SWL when the marine structure 10 is floating in the body of water 11.

Figure 3:
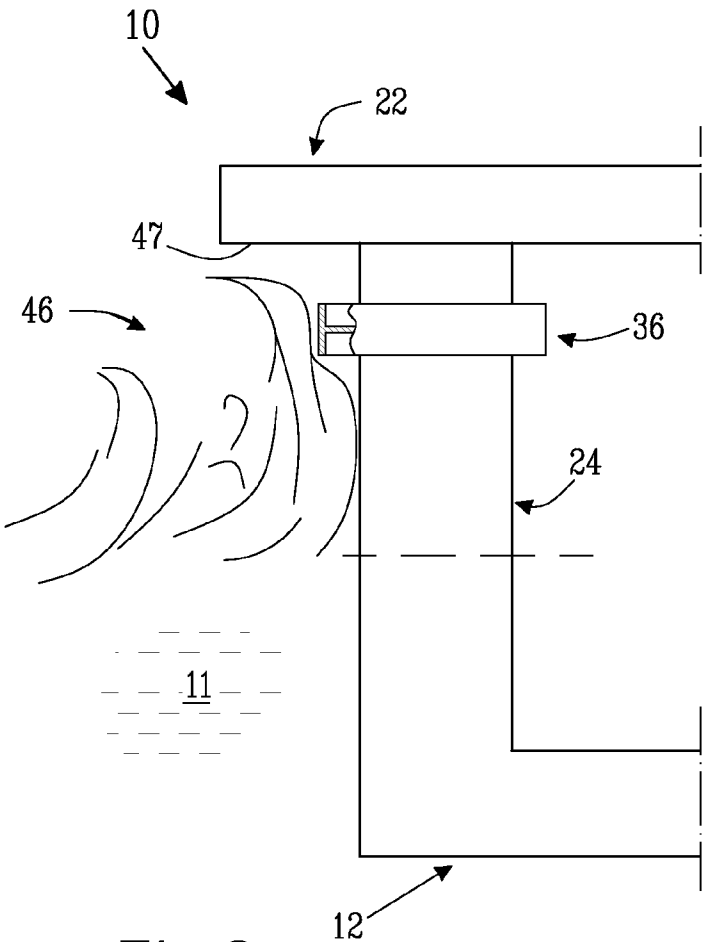
FIG. 3 illustrates the FIG. 2 semi-submersible structure when subjected to incident waves.

As such, apart from providing an appropriately large inner hollow volume 34 while still contributing to the stiffness of the supporting member 24, the provision of the stiffening web frame 36, when located in the upper portion 44, has an additional advantage which is illustrated in FIG. 3.

FIG. 3 illustrates a portion of the marine structure 10 of FIG. 2 when the structure 10 is subjected to large incident waves, which waves may for instance be wind induced. As may be realized by a person skilled in the art, when a wave 46 impacts the supporting member 24, the wave 46 will actually climb up on the member 24 resulting in that there is a risk that the bottom 47 of the deck structure 22 may be subjected to slamming loads from the waves. Such a phenomenon is usually referred to as wave run-up slamming.

However, due to the location and orientation of the stiffening web frame 36 of the present invention, a wave 46 travelling up the supporting member 24 will be at least partially deflected such that at least a portion of the wave 46 deflects from the supporting member 24. This deflection of the wave 46 results in that the slamming pressure and/or the slamming load area on the bottom 47 of the deck structure is reduced, and may in fact even be eliminated. As such, the run-up is impaired by the embodiment of the present invention illustrated in FIG. 2 and the stiffening web frame 36 may thus be referred to as a wave deflecting member of the supporting member 24.

Figure 4:
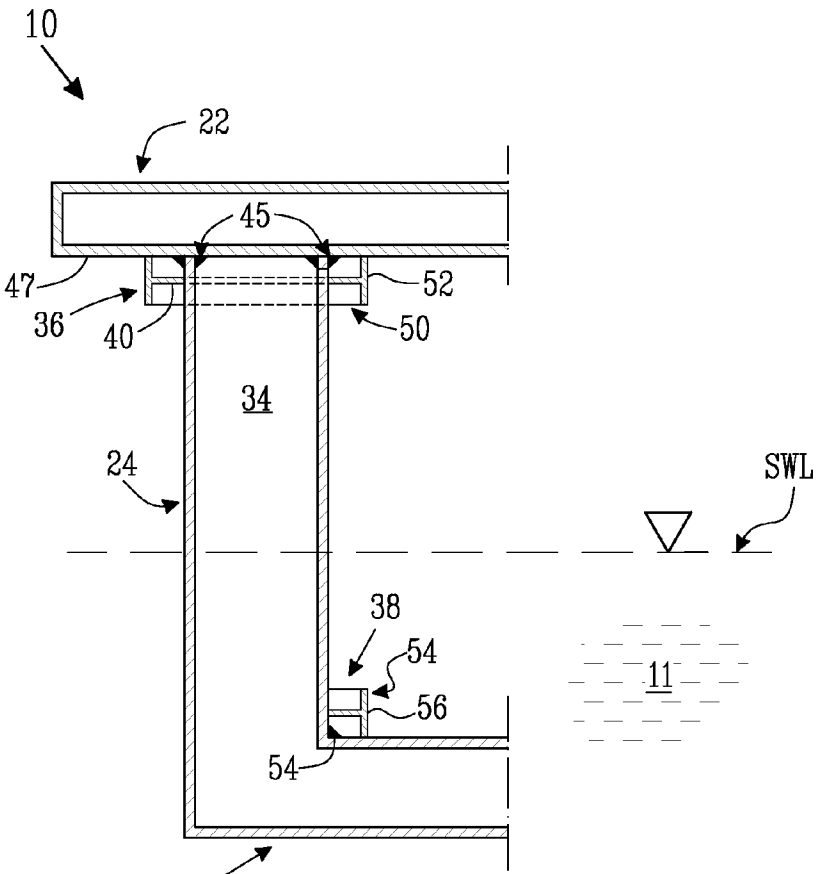
FIG. 4 illustrates a cross section of a portion of a semi-submersible structure according to a present embodiment.

FIG. 4 illustrates another location of the stiffening web frame 36. In FIG. 4, the supporting member 24 is attached to the deck structure 22 by means of a deck fastening arrangement 48 and the stiffening web frame 36 constitutes at least a portion of a deck enclosing member 50 enclosing at least a portion of the deck fastening arrangement 48. As may be gleaned from FIG. 4, the deck fastening arrangement 48 may comprise weld joints attaching the supporting member 24 to the deck structure 22. In order to protect the deck fastening arrangement 48, as well as the portion of the bottom 47 of the deck structure 22 being located in the vicinity of the deck fastening arrangement 48 but outside the supporting member 24, from wave slamming loads, a deck enclosing member 50 is provided to cover the deck fastening arrangement 48. As may be realized from FIG. 4, the stiffening web frame 36 constitutes at least a portion of such a deck enclosing member 50. Additionally, the deck enclosing member 50 may comprise a panel 52 connecting the stiffening web frame 36 and the bottom 47 of the deck structure 22, which panel 52 also serves as a flange for the stiffening web frame 36.

FIG. 4 illustrates that the supporting member 24 may be provided with an additional stiffening web frame 38 located at the bottom—i.e. the portion being closest to the float 12—of the supporting member 24. As may be gleaned from FIG. 4, the supporting member 24 illustrated therein is attached to the float 12 by means of a float fastening arrangement 54 comprising at least one joint. Generally, such a joint is a weld joint. Moreover, the marine structure 10 illustrated in FIG. 4 is provided with a float enclosing member 54 enclosing at least a portion of the aforesaid joint. As such, even when the marine structure 10 is floating in a body of water 11 such that the aforesaid joint is located below the still water level SWL, the joint will actually be in a dry, and thus mild, environment. As may be appreciated when studying FIG. 4, the stiffening web frame 38 constitutes at least a portion of the float enclosing member 54, such that—apart from providing additional structural capacity to at least the lower portion of the supporting member 24, the stiffening web frame 38 also contributes to providing a mild environment for the joint of the float fastening arrangement 54. FIG. 4 also illustrates that the float enclosing member 54 may be formed by the stiffening web frame 38 and a panel 54, such as a steel plate, connecting the stiffening web frame 38 and an upper side of the float 12.

Figure 5:
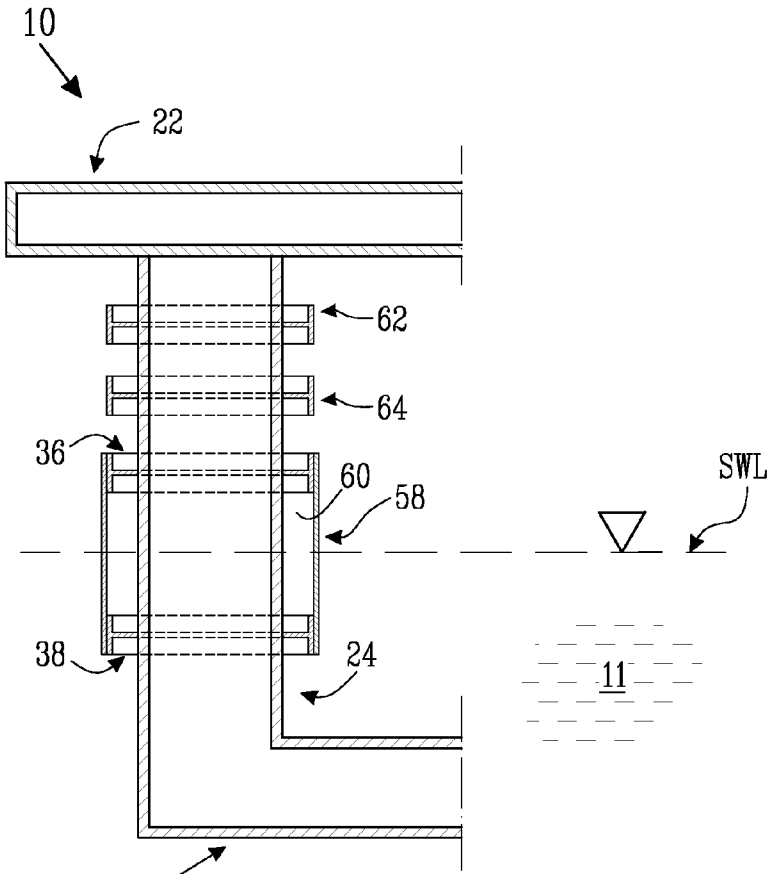
FIG. 5 illustrates a cross section of a portion of a semi-submersible structure according to another present embodiment.

FIG. 5 illustrates an additional embodiment of the present invention wherein the supporting member 24 comprises two stiffening web frames: a first stiffening web frame 36 adapted to be located above the still water level SWL and a second stiffening web frame 38 adapted to be located below the still water level SWL. The first 36 and second 38 stiffening web frames are connected to one another by a panel 58, such as a steel plate. As such, an enclosed volume 60 is formed around the supporting member 24 which enclosed volume 60 increases the buoyancy as well as the water plane area of the supporting member 24 and thus of the marine structure 10. It should be noted that the panel 58 also serves as a flange for both the first and second stiffening web frames 36, 38.

FIG. 5 further illustrates that in addition to the two stiffening web frames 36, 38 as discussed hereinabove, the supporting member 24 may be provided with a plurality of additional stiffening web frames, the flanges of which are located outside the wall 32 of the supporting member 24. In FIG. 5, two additional stiffening web frames 62, 64 are arranged between the still water level SWL and the deck structure 22 in order to impair wave run-up along the supporting member 24. As a result of the provision of the additional stiffening web frames 62, 64 in combination with the two stiffening web frames 36, 38 constituting a portion of the enclosed volume 60, there is no need for additional inwardly extending stiffening web frames in the portion of the supporting member 24 extending from the still water level SWL to the deck structure 22. This enables that at least a portion of the supporting member 24 may have a smooth inner surface which in turn result in that the available space inside the supporting member 24 is larger than the space inside a prior art supporting member 24 with the same, or at least similar, dimensions of the wall 32.

Figure 6:
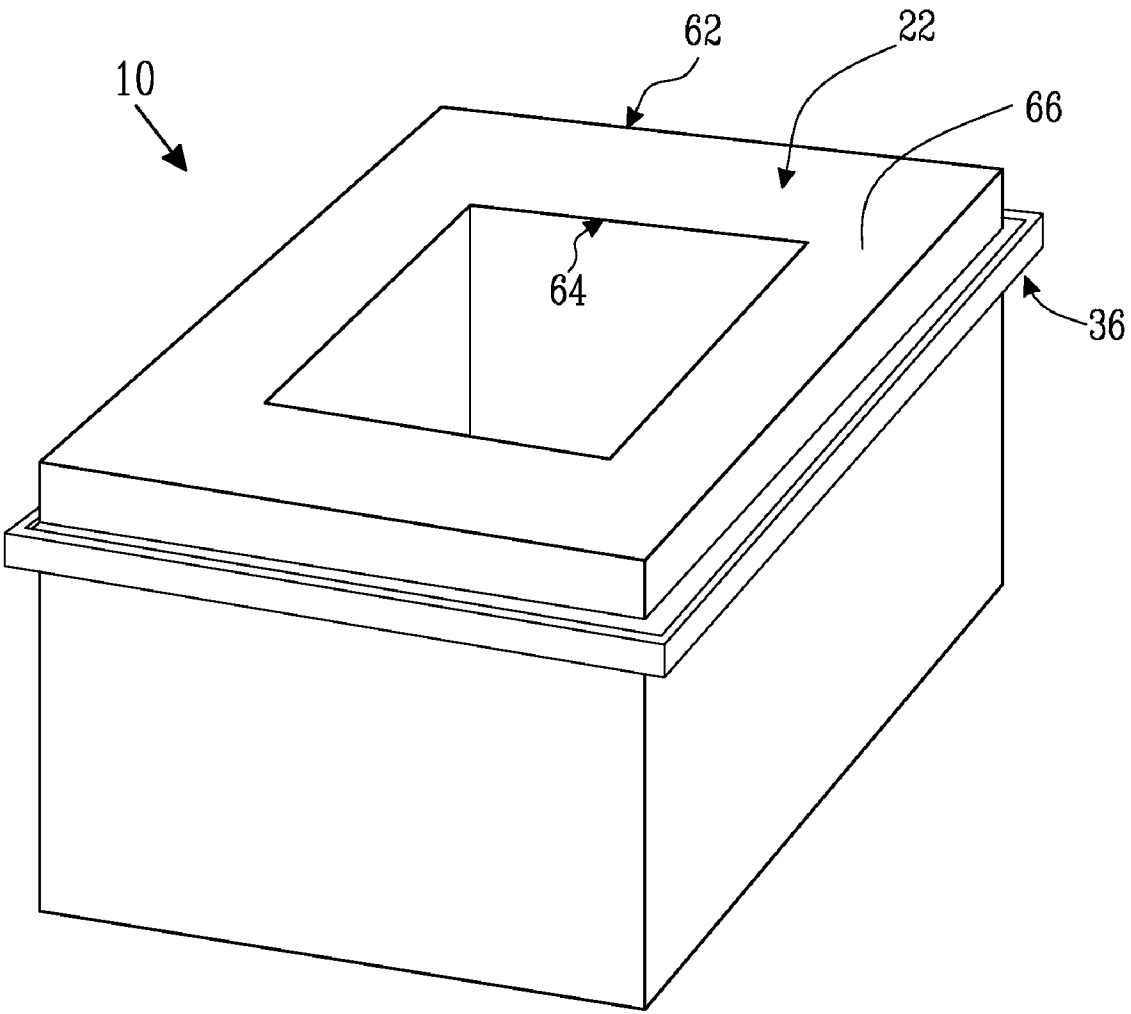
FIG. 6 schematically illustrates a perspective view of a marine structure of a ring wall type according to another present embodiment.

As regards the embodiments of the present invention as presented hereinabove, it should be noted that combinations of course may be formed, combining the stiffening web frames of two or more of the embodiments discussed with respect to FIG. 2 to FIG. 5. Moreover, although a semi-submersible unit comprising a plurality of columns has been used as an example of a marine structure 10 of the present invention, the invention also covers other types of marine structures 10. As an example, FIG. 6 illustrates a marine structure 10 of as so-called ring wall type having a supporting member 22 and an inner 62 and an outer wall 64 forming a closed hollow wall structure 66. As may be gleaned from FIG. 6, the marine structure of FIG. 6 is provided with a stiffening web frame 36 above the still water level SWL in order to impair wave run-up along the wall structure 66.

As may be realized when studying the embodiment according to FIG. 2 and FIG. 3 of the present invention, although it is advantageous to use an outwardly extending stiffening web frame 36 in order to obtain a wave deflecting member on a supporting member 24, a wave deflecting member need not necessarily be provided with a flange in order to deflect, or impair, a run-up wave.

Figure 7:
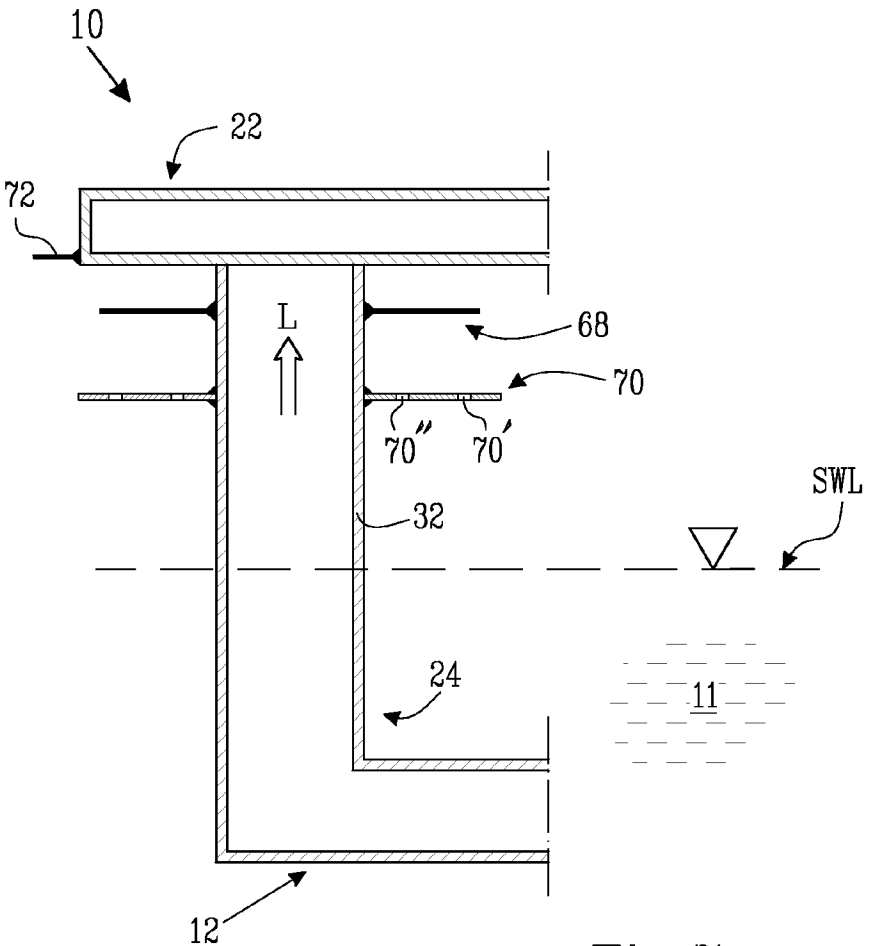
FIG. 7 illustrates a cross section of a portion of a marine structure according to a second aspect of the present embodiments.

As such, FIG. 7 illustrates two implementations of a wave deflecting member, namely an upper 68 and a lower 70 wave deflecting member, in accordance with a second aspect of the present invention. Apart from being provided with another type of wave deflecting member than the stiffening web frame 36 of the FIG. 2 embodiment, the design of the marine structure 10 illustrated in FIG. 7 is similar to the design of the FIG. 2 marine structure 10. What both the implementations of the wave deflecting member in FIG. 7 have in common is that they extend in a direction substantially perpendicular to the longitudinal extension L of the supporting member 24 and circumscribe the wall 32 of the member 24 so as to form a closed unit around the supporting member 24. Each one of the upper 68 and the lower 70 wave deflecting members will impair wave run-up in substantially the same manner as described hereinabove with reference to FIG. 3. FIG. 7 further illustrates a top wave deflecting member 72 attached to the deck structure 22 in order to prevent green water on the upper surface of the deck structure 22.

The upper wave deflecting member 68 comprises a steel plate and is attached to the supporting member 24 by means of a joint, such as a weld joint. The lower wave deflecting member 70 on the other hand comprises a plurality of openings 70', 70" extending substantially parallel to the longitudinal extension L of the supporting member 24. Preferably, the lower wave deflecting member 70 is constituted by a grating attached to the wall 32 of the supporting member 24 by means of welding. The purpose of the lower wave deflecting member 70 with the openings 70', 70" is to introduce air into the run-up wave, i.e. water passing the lower wave deflecting member 70 in a direction parallel to the longitudinal extension L, in order to reduce the slamming pressure on the deck structure 22.

Figure 8:
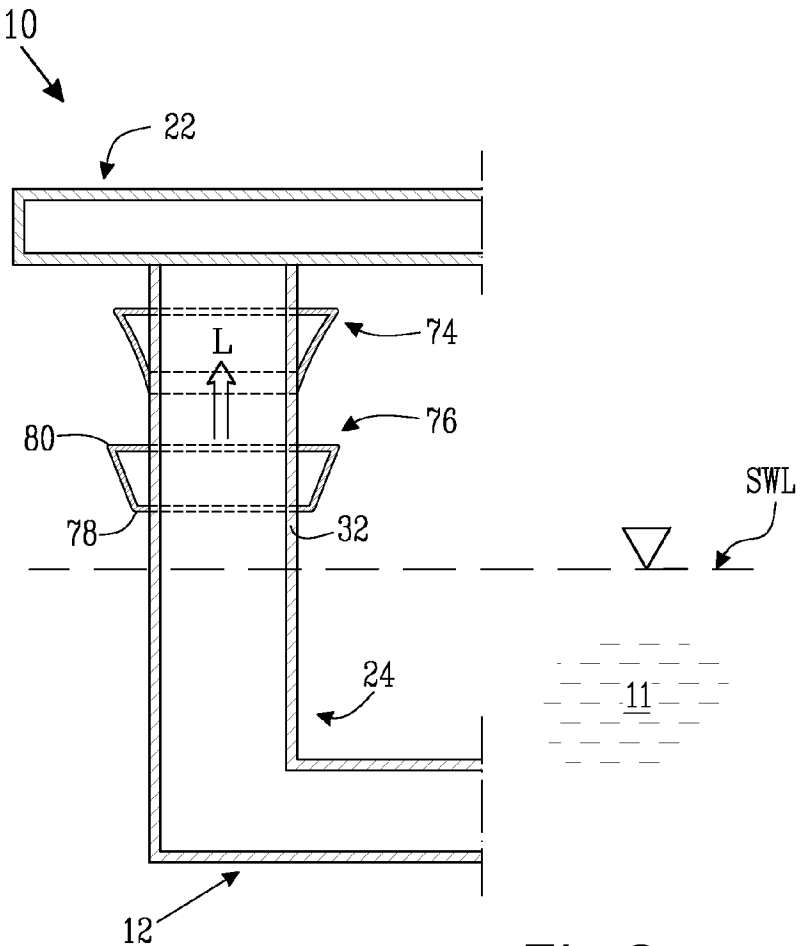
FIG. 8 illustrates a cross section of a portion of a marine structure according to another embodiment of the second aspect of the present embodiments.

FIG. 8 illustrates two additional implementations of the wave deflecting member. The lower wave deflecting member 76 in FIG. 8 has a tapering extension along the longitudinal extension L of the wall 32 such that a distance—which generally is a distance in a direction perpendicular to the longitudinal extension L—from the wall 32 to a portion 78 of the wave deflecting member 76 being located closest to the still water level SWL is less than a distance from the wall 32 to a portion 80 of the deflecting member 76 being located farthest away from the still water level SWL. As such, the lower wave deflecting member 76 in FIG. 8 is in the shape of a frustum of a cone wherein the narrowest portion of the cone is directed towards the still water level SWL.

The upper wave deflecting member 74 in FIG. 8 has a shape which is similar to the shape of the lower wave deflecting member 76 although the frustum of a cone for the upper wave deflecting member 74 is accurate.

It should be noted that although FIG. 7 as well as FIG. 8 illustrate marine structures 10 provided with two wave deflecting members, further embodiments of the second aspect of the present invention may envisage marine structures with only one single wave deflecting member or, optionally, a plurality of wave deflecting members Even though some features of the device and/or system according to the present invention have only been described with reference to one embodiment of the invention, any of the features of the invention may be used with any of the embodiments of the invention, unless otherwise specified. Further modifications of the invention within the scope of the claims would be apparent to a skilled person.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, the term should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A marine structure comprising a supporting member adapted to be located at least partially immersed in water said supporting member comprising a wall at least partially delimiting said supporting member such that an inner side of said wall at least partially delimits an inner hollow volume of said supporting member and an outer side of said wall is adapted to be in contact with the ambient environment of said supporting member, said supporting member further comprising a stiffening web frame attached to said wall in order to modify the structural capacity of said supporting member, said stiffening web frame comprising a rib and a flange, characterized in that said stiffening web frame is arranged such that said flange is located outside of said outer side of said wall in said ambient environment, and wherein said supporting member comprises an upper portion which is adapted to be located above a still water level when said marine structure is at least partially immersed in water, said stiffening web frame being located in said upper portion of said supporting member in order to impair wave run-up on said supporting member.

2. The marine structure of claim 1, wherein said wall extends along a longitudinal axis, said wall further forming a closed path in a circumferential direction about said longitudinal axis, wherein said stiffening web frame circumscribes said wall in a direction parallel to said circumferential direction.

3. The marine structure of claim 2, wherein said marine structure is a semi-submersible unit comprising a float, wherein said supporting member is a support column extending between said deck structure and said float.

4. The marine structure of claim 1, wherein said marine structure comprises a deck structure, wherein said supporting member extends from said deck structure.

5. The marine structure of claim 4, wherein said supporting member is attached to said deck structure by means of a deck fastening arrangement and said stiffening web frame constitutes at least a portion of a deck enclosing member enclosing at least a portion of said deck fastening arrangement.

6. The marine structure of claim 1, wherein said marine structure further comprises a float, wherein said supporting member is attached to said float by means of a float fastening arrangement comprising at least one joint and said stiffening web frame constitutes at least a portion of a float enclosing member enclosing at least a portion of said joint.

7. The marine structure of claim 1, wherein said supporting member comprises two stiffening web frames: a first stiffening web frame adapted to be located above a still water level and a second stiffening web frame adapted to be located below said still water level, said first and second stiffening web frames being connected to one another by means of a panel, such that said supporting member comprises an enclosed volume being at least partially defined by said outer side of said wall, said first stiffening web frame and said second stiffening web frame.

8. A marine structure comprising a supporting member adapted to be located at least partially immersed in water said supporting member comprising a wall at least partially delimiting said supporting member such that an inner side of said wall at least partially delimits an inner hollow volume of said supporting member and an outer side of said wall is adapted to be in contact with the ambient environment of said supporting member, said supporting member further comprising a stiffening web frame attached to said wall in order to modify the structural capacity of said supporting member, said stiffening web frame comprising a rib and a flange, characterized in that said stiffening web frame is arranged such that said flange is located outside of said outer side of said wall in said ambient environment, and wherein said supporting member comprises two stiffening web frames: a first stiffening web frame adapted to be located above a still water level and a second stiffening web frame adapted to be located below said still water level, said first and second stiffening web frames being connected to one another by means of a panel, such that said supporting member comprises an enclosed volume being at least partially defined by said outer side of said wall, said first stiffening web frame and said second stiffening web frame.

9. A marine structure comprising a supporting member adapted to be located at least partially immersed in water, said supporting member comprising a wall at least partially delimiting said supporting member such that an inner side of said all at least partially delimits an inner hollow volume of said supporting member and an outer side of said wall is adapted to be in contact with the ambient environment of said supporting member, said marine structure further comprising a deck structure such that said supporting member extends from said desk structure, said supporting member is attached to said deck structure by means of a deck fastening arrangement and said stiffening web frame constitutes at least a portion of a deck enclosing member enclosing at least a portion of said deck fastening arrangement, said supporting member further comprising a stiffening web frame attached to said wall in order to modify the structural capacity of said supporting member, said stiffening web frame comprising a rib and a flange, characterized in that said stiffening web frame is arranged such that said flange is located outside of said outer side of said wall in said ambient environment.

* * * * *

UNITED STATES PATENT AND TRADEMARK OFFICE

CERTIFICATE OF CORRECTION

PATENT NO. : 8,001,917 B2
APPLICATION NO. : 12/347205
DATED : August 23, 2011
INVENTOR(S) : Daniel Astrand It is certified that error appears in the above-identified patent and that said Letters Patent is hereby corrected as shown below:

Title Page, Item (73) Assignee:
currently Issued as

"Kellogg Brown & Root LLC
601 Jefferson Avenue
Houston Texas 77002
USA"

Assignee should be:

--GVAC Consultants AB
Valea AB
Lindholmspiren 5
SE-417 56 Gothenburg
Sweden--.

Signed and Sealed this
Twenty-seventh Day of December, 2011

David J. Kappos

David J. Kappos
*Director of the United States Patent and Trademark Office*